US007125351B1

(12) United States Patent
Raber

(10) Patent No.: US 7,125,351 B1
(45) Date of Patent: Oct. 24, 2006

(54) PORTABLE, FOLDABLE GOAL ASSEMBLY

(76) Inventor: Richard A. Raber, 1211 Stoney Run Dr., Wilmington, DE (US) 19803

( * ) Notice: Subject to any disclaimer, the term of this patent is extended or adjusted under 35 U.S.C. 154(b) by 159 days.

(21) Appl. No.: 10/902,606

(22) Filed: Jul. 29, 2004

Related U.S. Application Data

(63) Continuation-in-part of application No. 10/702,983, filed on Nov. 5, 2003, now Pat. No. 6,979,274.

(51) Int. Cl.
*A63B 63/00* (2006.01)

(52) U.S. Cl. ..... 473/478; 473/471

(58) Field of Classification Search ..... 473/478, 473/471, 470, 465, 476; 273/400
See application file for complete search history.

(56) References Cited

U.S. PATENT DOCUMENTS

| | | | | |
|---|---|---|---|---|
| 2,449,708 | A | | 9/1948 | Lindsay |
| 3,184,235 | A | | 5/1965 | Hilbrich |
| 4,083,561 | A | | 4/1978 | Daffer, Jr. |
| 4,116,446 | A | | 9/1978 | Thompson |
| 4,127,272 | A | | 11/1978 | Pennell |
| 4,258,923 | A | | 3/1981 | Senoh |
| 4,258,924 | A | | 3/1981 | Ketchum |
| 4,286,786 | A | | 9/1981 | Papadopoulos |
| 4,407,507 | A | | 10/1983 | Caruso et al. |
| 4,420,158 | A | | 12/1983 | Klock et al. |
| 4,664,384 | A | | 5/1987 | Solla |
| 4,702,478 | A | | 10/1987 | Kruse |
| 4,842,284 | A | | 6/1989 | Rushing et al. |
| 5,000,461 | A | | 3/1991 | Borazjani |
| 5,048,844 | A | | 9/1991 | Haseltine |
| 5,080,375 | A | | 1/1992 | Moosavi |
| 5,186,469 | A | * | 2/1993 | Terris ..... 473/478 |
| 5,244,213 | A | | 9/1993 | Armell |
| 5,273,292 | A | | 12/1993 | Pardi et al. |
| 5,308,083 | A | | 5/1994 | Grunfeld et al. |
| 5,372,368 | A | * | 12/1994 | Pavonetti ..... 473/478 |
| 5,407,211 | A | | 4/1995 | Bottiglieri |
| 5,413,340 | A | | 5/1995 | Potvin et al. |
| 5,413,356 | A | | 5/1995 | Bigelow |
| 5,421,586 | A | | 6/1995 | Amram et al. |
| 5,427,381 | A | | 6/1995 | Macaluso et al. |
| 5,431,411 | A | | 7/1995 | Padilla |
| 5,496,040 | A | | 3/1996 | Amburgey et al. |
| 5,533,733 | A | | 7/1996 | Dirnbeck |
| 5,539,957 | A | | 7/1996 | Schmidt |
| 5,553,863 | A | | 9/1996 | Wynne |
| 5,562,288 | A | | 10/1996 | Erkebaev |
| 5,566,952 | A | * | 10/1996 | Mullin et al. ..... 273/400 |

(Continued)

*Primary Examiner*—Eugene Kim
*Assistant Examiner*—M. Chambers
(74) *Attorney, Agent, or Firm*—Harrity Snyder, LLP

(57) ABSTRACT

A portable goal assembly that folds in two dimensions is disclosed. The goal assembly includes tubular members, most of which are connected by hinges to facilitate movement between expanded and collapsed configurations. The hinges may be of the releasable lockable sleeve type to provide bracing when the goal assembly is in its expanded configuration. The goal assembly includes a pair of U-shaped, open-ended frames pivoted together by hinges at their open ends and also connected by two diagonal braces mounted to the frame by rotating tee fittings. The diagonal braces fold on hinges when the frames are pivoted substantially parallel to each other to make the goal assembly nearly flat. The center members of each frame also fold on hinges to reduce the size of the goal still further. Once folded for transport or storage, the goal assembly may be carried by a shoulder strap.

16 Claims, 5 Drawing Sheets

U.S. PATENT DOCUMENTS 5,580,064 A 12/1996 Childers, Jr.
5,655,774 A 8/1997 Cox
5,681,045 A * 10/1997 Liao ..... 273/400
5,690,339 A 11/1997 Chen
5,830,089 A 11/1998 Halter et al.
5,839,733 A * 11/1998 Meeks et al. ..... 273/400
5,857,928 A 1/1999 Stewart
5,902,195 A 5/1999 Pavonetti
5,902,196 A 5/1999 Chorneyko
5,951,415 A 9/1999 Gates et al.
5,954,600 A 9/1999 Gill
6,149,152 A 11/2000 Mancke
6,209,878 B1 4/2001 Munro
6,371,873 B1 * 4/2002 Wang ..... 473/478
6,402,643 B1 6/2002 Gill
6,629,900 B1 * 10/2003 Wu ..... 473/478
6,979,274 B1 * 12/2005 Raber ..... 473/478

* cited by examiner 10
14
16
17
18
19
20
21
22
25

14
18
10
17
13A
100
13B
11
22
12
20
26
27
23
21
25

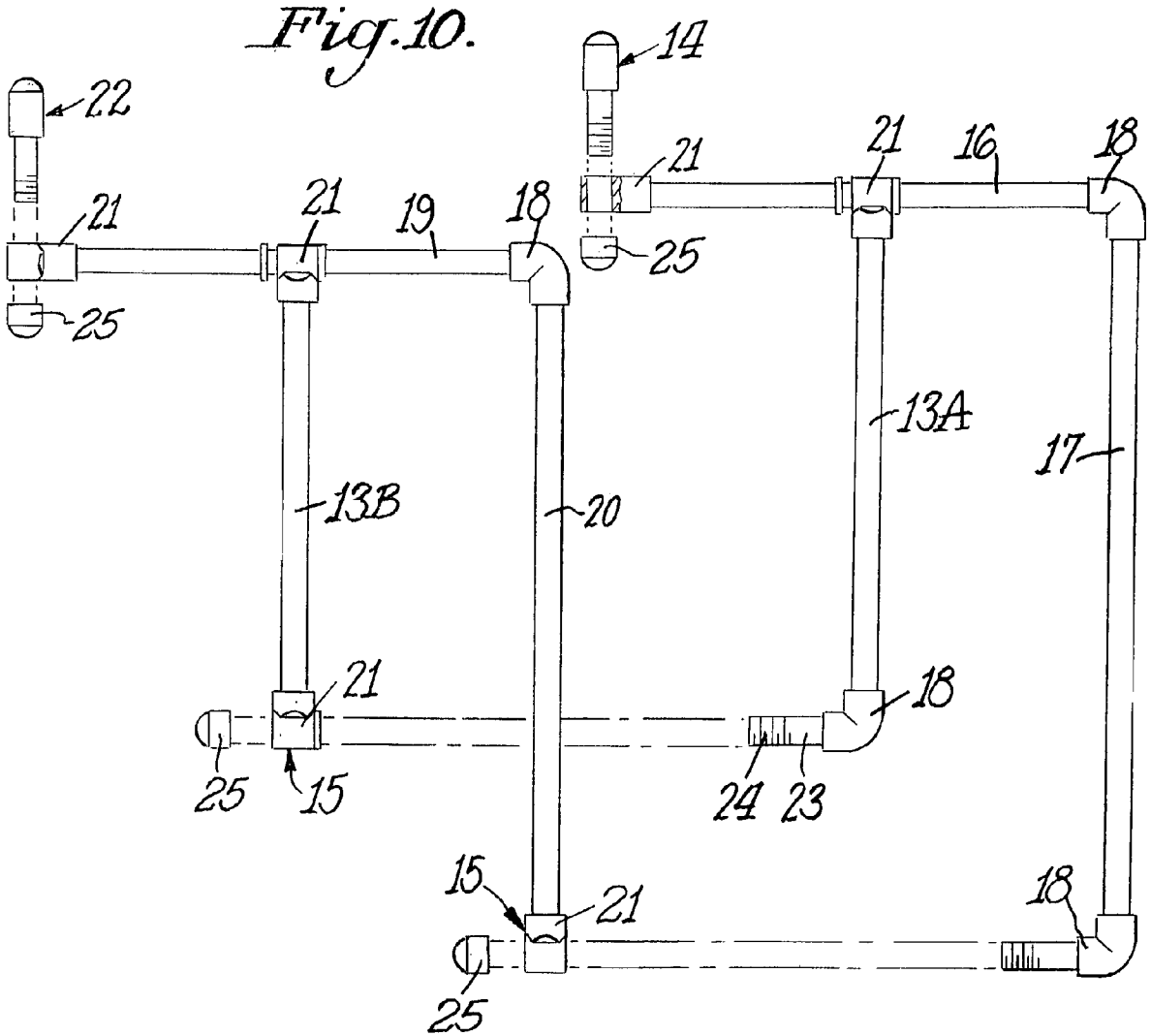
Fig. 10.
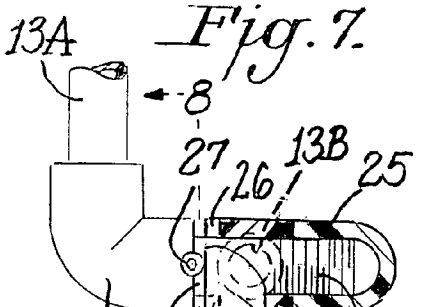
Fig. 7.
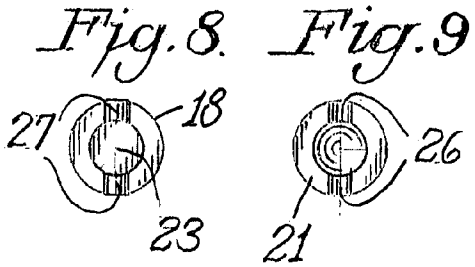
Fig. 8.
Fig. 9

PORTABLE, FOLDABLE GOAL ASSEMBLY

CROSS-REFERENCE TO RELATED APPLICATIONS

The present application is a continuation-in-part of U.S. patent application Ser. No. 10/702,983, filed Nov. 5, 2003, now U.S. Pat. No. 6,979,274, the disclosures of which is incorporated by reference herein in its entirety.

BACKGROUND OF THE INVENTION

A. Field of the Invention

The present invention relates generally to portable, folding, collapsible goal assemblies, and, more particularly, to a portable, foldable goal assembly of tubular construction that presents an upright and inverted U-shaped opening to serve as the goal mouth.

B. Description of the Related Art

The growing popularity of the sport of soccer, as well as other team sports, such as roller hockey and lacrosse, has spurred considerable interest in creating goals that improve upon the traditional version. In the United States, for instance, such games are considered among the fastest growing sports, particularly in regard to youth participation.

However, the practice environment for such sports is not ideal. This is especially the case in the informal practice environment, outside the realm of organized league sports. Consider that basketball hoops are common in many driveways and recreational parks, allowing for impromptu competition, short-sided games (i.e., fewer players than the standard game calls for), or even solitary practice. That situation stands in sharp contrast to the facilities available to soccer players. While many recreational facilities have soccer goals, the nets are usually only attached when official league games are being played, a measure designed to guard against theft and wear and tear of the large nets. In addition, standard, non-portable soccer goals are designed for full-sided games featuring twenty-two players, which is usually too many to assemble for what are known as "pick-up games." The situation is no better for roller hockey players or participants in other sports that use smaller goals. Few facilities have invested in built-in goals for such sports, as they have for basketball hoops or tennis nets.

Even in formal practice environments, the need for smaller soccer goals is great. One reason for this is limited field space. By using a shortened field and a smaller goal without a goalkeeper, coaches can have many practice games going on at once. Such games have become a staple in soccer training, not only because of their convenience, but because such games allow players to receive the ball more often, and place a greater emphasis on speed, ball control, teamwork and decision-making. Also, these games, known as "small-sided games," can be conducted indoors during the winter.

In view of the above, there is a growing need for portable goals that can be used by both children and adults. Ideally, such goals can be transported by car or by foot, set up quickly, and then removed when play is concluded. The related art features a variety of goals that attempt to meet some or all of these demands. Among these goals are those shown in U.S. Pat. Nos. 5,830,089; 5,533,733; 5,431,411; 5,308,083; 5,273,292; 5,244,213; 5,186,469; 5,080,375; and 4,407,507. While all of these goals have certain strong points, each has its own shortcomings. Some, for instance, may be reduced in size such that they fit into a car. However, such goals must be disassembled, which poses the possibility of lost pieces, as well as time-consuming and cumbersome assembly and disassembly, in some cases, that is too difficult for children. Other goals, such as the one disclosed in U.S. Pat. No. 5,244,213, are lightweight and collapsible, yet have a pup-tent-like form and must be staked into the ground to remain sufficiently stationary when hit by a ball. Unfortunately, such goals are unsuitable for indoor use, play during summer when the ground may be hard, or for games in which a simulacrum traditional goal is desired (i.e., balls caroming off goal posts, etc.).

Other goals in the related art, such as the goal shown in U.S. Pat. No. 5,431,411, present drawbacks such as fragility at the side post joints due to lack of support from braces that would give the structure a stable triangular profile. Other goals, such as the goals of U.S. Pat. Nos. 5,539,957 and 5,533,733, have only one central brace supporting the crossbar, allowing the crossbar to twist on impact and increasing the possibility of breakage. Such goals may work well for sports such as roller hockey, in which a relatively lightweight plastic puck is used, but present significant drawbacks for soccer, especially adult soccer in which goals continually receive impacts from larger, heavier balls moving at high speeds.

Some goals in the related art are too bulky to carry easily, while others include a multitude of complex, costly-to-produce components, or potentially dangerous metal parts, such as wing nuts and bolts and detent-and-notch formations, features that are not easily manipulated by small children.

Finally, to be truly portable a relatively large goal must be collapsible in a multi-dimensional fashion. That is, it must be narrow and flat so that at least two such devices can fit in the trunk of car. U.S. Pat. No. 5,830,089, for example, discloses a collapsible goal, but this device folds in only one dimension. The collapsed version of such a goal is similar to an extremely large picture frame, a shape that makes storage somewhat easier but does little to provide portability, as transport by car is extremely difficult. Thus, there is a need in the art for a portable, foldable goal assembly that overcomes the deficiencies of the related art.

SUMMARY OF THE INVENTION

The present invention solves the problems of the related art by providing a collapsible goal assembly to which a net is attached by connector loops. The goal assembly includes tubular members, most of which are connected by hinges to facilitate movement between expanded and collapsed configurations. To provide the necessary bracing when the goal assembly is in its expanded configuration, such hinges are lockable.

In accordance with the purpose of the invention, as embodied and broadly described herein, the invention comprises a goal assembly that includes a U-shaped base frame and an inverted U-shaped goalmouth frame. Each U-shaped frame includes two side members and a longer, central connecting member which are attached to each other by ninety-degree elbow connectors. Hinges connect the two U-shaped frames at their open ends so that they can be pivotally moved toward one another until the goalmouth frame and base frame are folded into a flat, or nearly co-planar, position. The central members of the two U-shaped frames also are connected by two diagonal struts. The two struts are hinged so that they fold when the goalmouth frame and base frame are folded into the flat position. The central member of each U-shaped frame is also hinged at a midpoint. Once the goal assembly is in its flat position, it can be folded in half laterally at the hinges of the central members of the U-shaped frames. The goal assembly's fully folded shape is basically that of an "L". The goal assembly may further include a strap that extends across the open portion of the "L" so that the folded assembly can be transported over a person's shoulder.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description. It is to be understood that both the foregoing general description and the following detailed description are exemplary and explanatory only and are not restrictive of the invention, as claimed.

BRIEF DESCRIPTION OF THE DRAWINGS

The present invention will become more fully understood from the detailed description given herein below and the accompanying drawings which are given by way of illustration only, and thus are not limitative of the present invention, and wherein:

FIG. 7 is a partial side elevational view with parts in cross section of the elbow fitting, tee fitting, and cap shown in FIGS. 5 and 6;

FIG. 8 is a bottom plan view of the elbow fitting, tee fitting, and cap shown in FIGS. 5–7, looking in the direction 8—8 of FIG. 7 and showing the projection on the elbow fitting;

FIG. 9 is a top plan view of the elbow fitting, tee fitting, and cap shown in FIGS. 5–8 and showing the mating of the notches and tee fitting;

FIG. 10 is an exploded side elevational view of the one side of the goal assembly shown in FIG. 1 and showing the right and left side connectors;

DETAILED DESCRIPTION OF EMBODIMENTS OF THE INVENTION

The following detailed description of the invention refers to the accompanying drawings. The same reference numbers in different drawings identify the same or similar elements. Also, the following detailed description does not limit the invention. Instead, the scope of the invention is defined by the appended claims and equivalents thereof.

Figure 1:
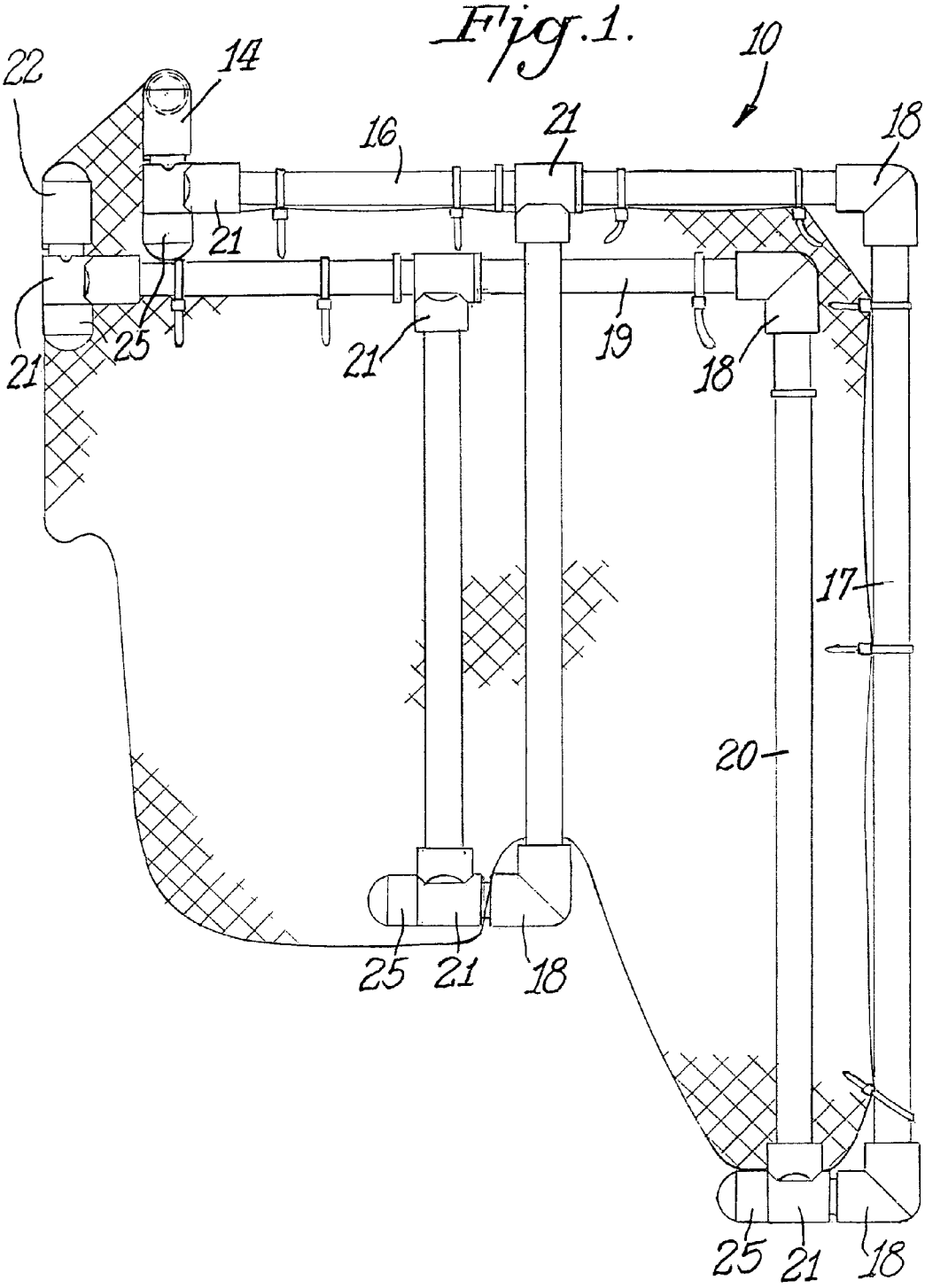
FIG. 1 is a side elevational view showing a goal assembly of the present invention in its fully folded (folded in two directions) transportable configuration.
Figure 2:
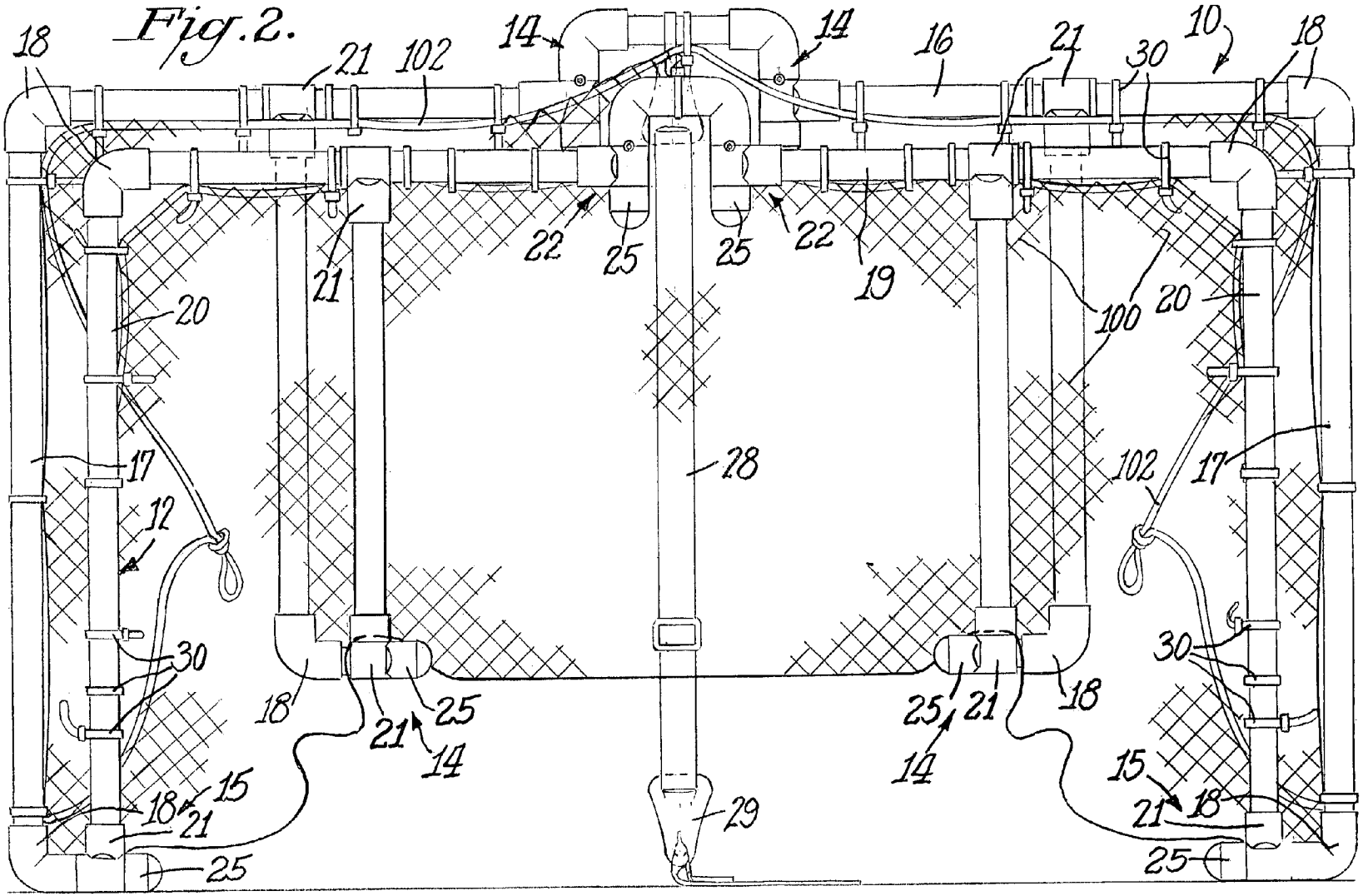
FIG. 2 is a front elevational view of the goal assembly shown in FIG. 1 with the goal assembly being folded in one direction.
Figures 3, 4, 5, 6:
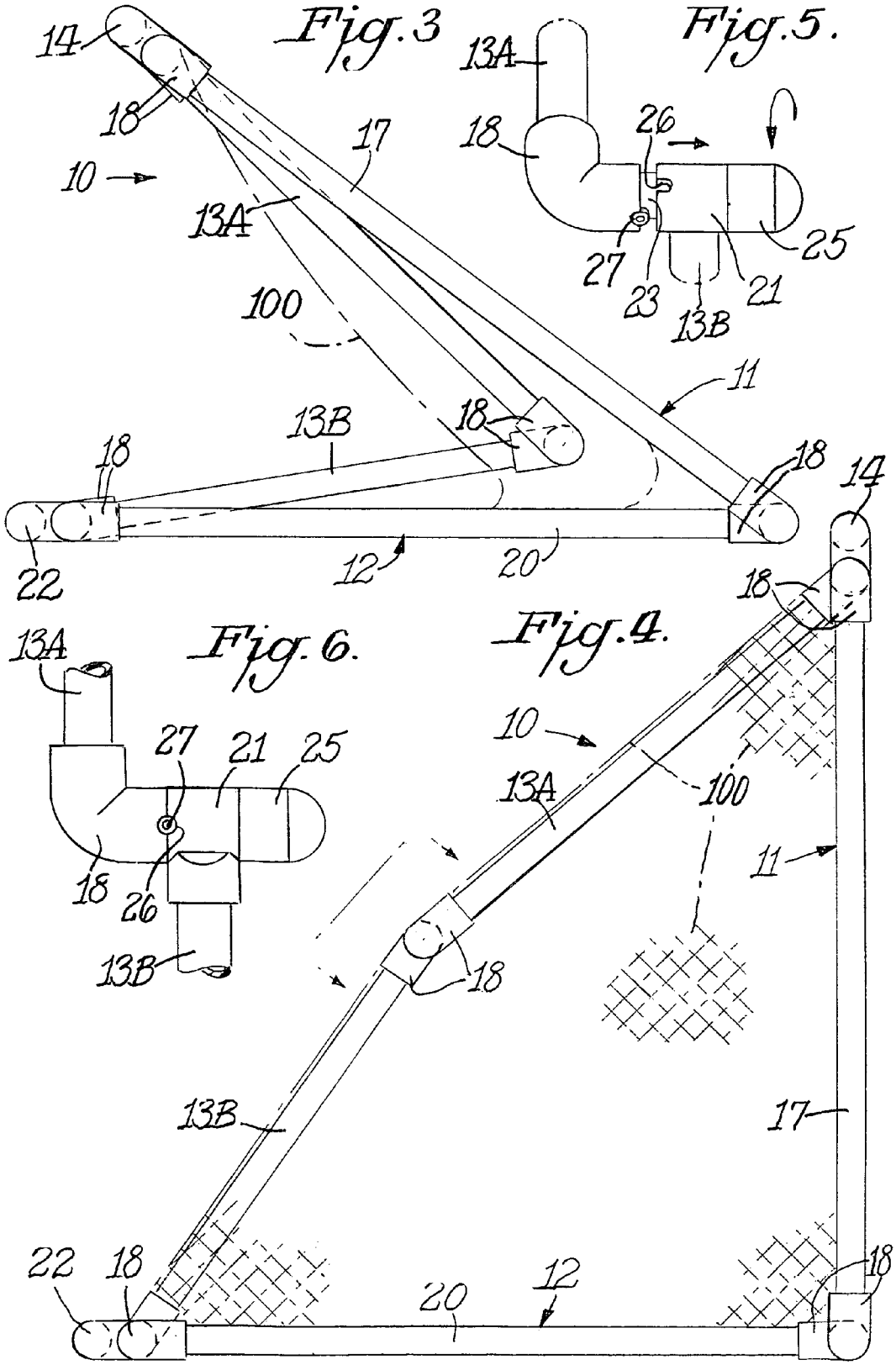
FIG. 3 is a side elevational view of the goal assembly shown in FIG. 1 in a partially folded configuration.
FIG. 4 is a side elevational view of the goal assembly shown in FIG. 1 in its fully expanded (unfolded) operational configuration.
FIG. 5 is a partial front elevational view of a rotated elbow fitting, tee fitting, and cap of the goal assembly shown in FIG. 1 in its unlocked position.
FIG. 6 is a partial front elevational view of the elbow fitting, tee fitting, and cap shown in FIG. 5 in its fully rotated and locked position.

A goal assembly of tubular structure of the present invention is shown generally in FIG. 1 as reference numeral 10. The basic structure and tubular components of goal assembly 10 are shown in FIGS. 1–4. FIG. 1 shows goal assembly 10 in its fully folded (folded in two directions) transportable configuration. FIG. 2 shows goal assembly 10 folded in one direction. FIG. 4 shows goal assembly 10 in its fully expanded (unfolded) operational configuration, or use mode. The primary components of goal assembly 10 are an upright goalmouth frame 11, a ground-engaging base frame 12, diagonal braces 13A, 13B, releasably lockable hinges 14, and frame hinges 15. Preferably, each of the tubular components of goal assembly 10 is molded from a lightweight and durable plastic material. However, other lightweight, inexpensive materials may be used for the tubular components, and goal assembly 10 of the present invention is not limited to this material of construction.

Goalmouth frame 11 may include a crossbar 16 and two side posts 17 connected by two ninety-degree elbow fittings 18. Crossbar 16 and side posts 17 may be rigidly secured by elbow fittings 18 to form an inverted, U-shaped configuration.

Base frame 12 may be similarly constructed. Base frame 12 may be the same size as or larger than goalmouth frame 11, but preferably is slightly smaller than goalmouth frame 11 so that base frame 12 may fit inside goalmouth frame 11 when folded for transport or storage. Base frame 12 may include a rearward cross member 19 and a pair of side members 20 rigidly connected by elbow fittings 18. Preferably, base frame 12 has the same shape as goalmouth frame 11 and is connected by its side members to goalmouth frame 11 at the open end of its U-shaped configuration.

In the fully-extended (unfolded) configuration of goal assembly 10, goalmouth frame 11 stands perpendicular to the ground, mutually perpendicular to the ground-engaging base frame 12. Side posts 17 connect at ground level to base frame 12 by frame hinges 15. Each frame hinge 15 connects at a front end of each corresponding side member 20 and at a bottom end of each corresponding side post 17. Frame hinges 15, which allow goalmouth frame 11 and base frame 12 to pivot toward one another into a substantially parallel relation, are described in more detail below.

In addition to being connected at frame hinges 15, goalmouth frame 11 and base frame 12 may be connected by diagonal braces 13A, 13B, as shown in FIGS. 3 and 4. Each diagonal brace 13A may connect to crossbar 16 of goalmouth frame 11 and each diagonal brace 13B may connect with rearward cross member 19 of base frame 12 through tee fittings 21. Tee fittings 21 may be bracketed by stop rings rigidly affixed to crossbar 16 and rearward cross member 19, that prevent tee fittings 21 from sliding laterally. Each tee fitting 21 provides an internal cylindrical surface that snugly embraces the tubular member to which it is connected. However, the fit is loose enough to permit rotation of each tee fitting 21 and thus the corresponding diagonal brace 13A, 13B to which it is connected, when a person applies a slight amount of force to rotate it about the tubular member. When such force is applied to goal assembly 10, tee fittings 21 rotate freely on crossbar 16 and rearward cross member 19. Diagonal braces 13A, 13B form a top leg that is slightly longer than a bottom leg and may be joined by releasably lockable hinges 14 near their midpoints. When goalmouth frame 11 and base frame 12 are folded toward one another as shown in FIG. 3, diagonal braces 13A, 13B fold on their hinges 14 and tee fittings 21 rotate on crossbar 16 and rearward member 19. This folding action brings hinges 14 inward toward frame hinges 15, allowing goal assembly 10 to achieve a flattened position with goalmouth frame 11 and base frame 12 in a nearly co-planar position, as shown in FIG. 2.

Once in the flattened position, goal assembly 10 may be folded again along releasably lockable hinges 14 in crossbar 16 and unlockable hinges 22 in rearward cross member 19, i.e., in a second direction. This fold brings side posts 17 of goalmouth frame 11 and side members 20 of base frame 12 together, as shown in FIG. 1.

As heretofore described, goal assembly 10 may be folded flat and then in half in a second direction so that it can be easily transported or stored. To achieve this reduction in size, the invention employs eight hinges 14, 15, 22 that allow the goal assembly's tubular components to collapse toward one another. Four of these hinges (hinges 14) are releasably lockable. That is, when goal assembly 10 is in its fully expanded configuration, these hinges can be locked to provide the rigidity necessary to withstand repeated impact. The other four hinges (hinges 15, 22) are nearly identical in structure and function, however they have no locking mechanism and thus need no manipulation by a user.

The releasably lockable hinges 14 feature the mating of an elbow fitting and tee fitting, each of which are attached to the tubular members of goal assembly 10. As shown in FIG. 5, each hinge includes an elbow fitting 18 into which a tubular extension 23 is affixed. Extension 23 has threads 24 on the end that protrudes from elbow fitting 18. As shown in FIG. 7, extension 23 fits through a tee fitting 21 such that tee fitting 21 can freely rotate and laterally slide on extension 23. Extension 23 is of a length that allows threaded end 24 to protrude from the opening of tee fitting 21, opposite the end from which it is inserted. A cap 25 may be twisted on to threaded end 24. When cap 25 is tightened as shown in FIG. 5, the pressure from the inward motion of cap 25 causes tee fitting 21 to slide along threaded extension 23, bringing the opening of tee fitting 21 flush with the opening of elbow fitting 18. The pressure from this meeting alone provides a certain level of stability to the hinge.

However, a locking mechanism may be used to make the hinges of goal assembly 10 rigid enough to withstand repeated impacts from balls and other collisions. For example, tee fitting 21 may have two notches 26 which are diagonally opposed from one another across the opening of tee fitting 21. When cap 25 is tightened, these notches 16 interlock with corresponding mating protrusions 27 that protrude from the threaded extension 23. Notches 26 and mating protrusions 27 on each hinge are circumferentially positioned so that when they interlock, goal assembly 10 is in the fully expanded position. To release the hinge from its locked position, cap 25 may be partially unscrewed. The release of pressure against the tee fitting 21 allows tee fitting 21 to slide back from elbow fitting 18 so that elbow fitting 18 and the tee fitting 21 are no longer flush. In the space created, the mating protrusions 27 may move unimpeded as goal assembly 10 is folded into storage position and tee fitting 21 and elbow fitting 18 rotate in opposite directions. FIGS. 5–9 show releasably lockable hinges 14. Unlockable hinges 15, 22 are the same as lockable hinges 14 except that they do not have protrusions 27 or notches 26.

From its fully expanded configuration, goal assembly 10 may be collapsed into its transport and storage position by turning caps 25 on the four releasably lockable hinges 14 several rotations. Once tee fittings 18 are disengaged from mating protrusions 27, goalmouth frame 11 can be pivoted down toward base frame 12. Then side posts 17 may be drawn together to fold the flat goal assembly 10 in half. The residual frictional force of unlockable hinges 15,22 and unlocked lockable hinges 14 is sufficient to keep the fully folded goal assembly in a compact unit as it is transported.

Goal assembly 10 may include a net or netting 100 that attaches to goal assembly 10 with connectors such as the tie wrap connectors 30 shown in FIG. 2. Net 100 may or may not include a reinforcement cord 102 that reinforces net 100 at locations where net 100 connects to goal assembly 10. Finally, goal assembly 10 may include a strap 28 rotatably affixed to the crossbar 16 for carrying the fully-folded assembly 10, as shown in FIG. 2. Strap 28 may connect to the folded side members 20 with a loop 29 that can be opened and closed with a buckle, hook and pile (e.g., Velcro) fastener or the like.

The goal assembly 10 can be broken down for shipment or part replacement as shown in FIG. 10.

Figure 11:
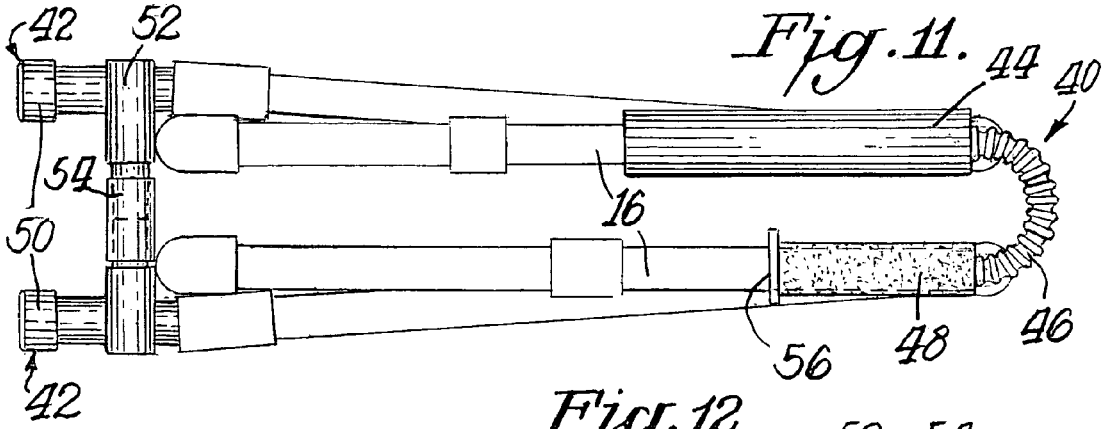
FIG. 11 is a top plan view of an alternate embodiment of the goal assembly shown in FIG. 1, wherein the alternate embodiment includes lockable leg portions and releasably lockable sleeve hinges.

An alternate embodiment of the goal assembly of the present invention is shown in FIGS. 11–14. The alternate embodiment of the goal assembly is identical to goal assembly 10 shown in FIGS. 1–10, except that releasably lockable hinges 14 are replaced with releasably lockable sleeve hinges 40, and base frame 12 of goal assembly 10 includes lockable leg portions 42, as shown in FIG. 11, which replace elbow fittings connecting cross members 19 to side members 20. Releasably lockable sleeve hinges 40 are less complex and easier to use than releasably lockable hinges 14, enabling goal assembly 10 to be folded and unfolded more expeditiously. Lockable leg portions 42 provide support for goal assembly 10 so that it may be free standing in its folded position, and also lock goal assembly 10 into its folded position to provide a more compact unit and prevent goal assembly 10 from unfolding during transport.

Figure 13:
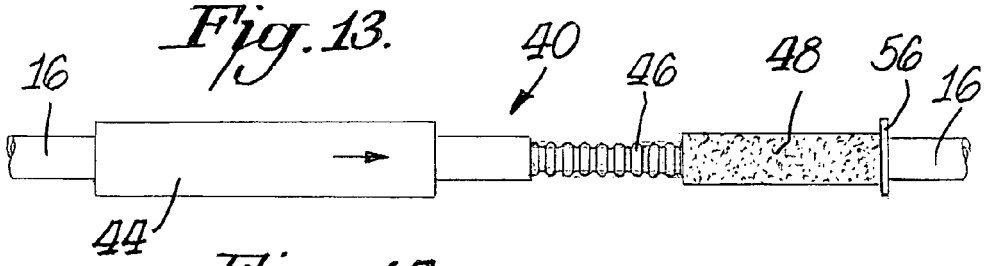
FIG. 13 is a fragmental side elevational view of a releasably lockable sleeve hinge of the goal assembly shown in FIG. 11, the releasably lockable hinge being shown in its unlocked position.
Figure 14:
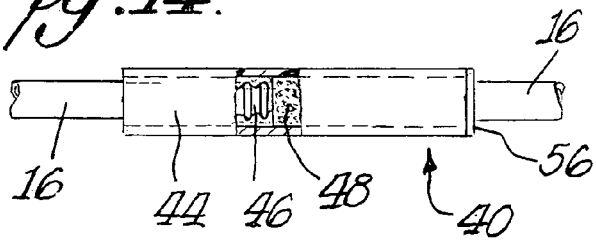
FIG. 14 is a fragmental side elevational view of a releasably lockable sleeve hinge of the goal assembly shown in FIG. 11, the releasably lockable hinge being shown in its locked position.

FIGS. 11 and 13 show a releasably lockable sleeve hinge 40 in its unlocked position. As shown in these Figures, each releasably lockable sleeve hinge 40 includes a hollow, cylindrical rigid sleeve 44 through which the tubular components of goal assembly 10 are capable of extending. Rigid sleeve 44 may be made from a variety of materials, including a lightweight and durable plastic material. However, other lightweight, inexpensive materials may be used for rigid sleeve. Each releasably lockable sleeve hinge 40 further includes a bendable connection mechanism 46 that connects the ends of two tubular components of goal assembly 10 together in a hinged fashion much the same way releasably lockable hinges 14 connect tubular components together. Bendable connection mechanism 46 may be integrally formed with tubular components, but preferably is separate from but connected to tubular components. FIG. 11 shows bendable connection mechanism 46 in its bent or folded configuration, whereas FIGS. 13 and 14 show bendable connection mechanism 46 in its straight or unbent configuration. Bendable connection mechanism 46 may be made from a variety of materials, including but not limited to, materials used to make flexible conduit, plastics, etc. Finally, each releasably lockable sleeve hinge 40 includes a deformable sleeve 48 which is provided around and connected to the outer surface of one of the tubular components. Deformable sleeve 48 may be made from a variety of materials, including but not limited to a resilient material (such as, e.g., Neoprene), etc.

Deformable sleeve 48 may be replaced with a stop mechanism 56 that prevents rigid sleeve 44 from sliding past a certain distance along the length of the tubular components. Stop mechanism 56, thus positions rigid sleeve 44 over bendable connection mechanism and locks releasably lockable sleeve hinge 40. Stop mechanism 56 may include a flange extending from and provided around the periphery of one of the tubular components. Stop mechanism 56 may be integrally formed with or separate from but connected to one of the tubular components.

FIGS. 11 and 13 show releasably lockable sleeve hinge 40 in its unlocked position, whereas FIG. 14 shows releasably lockable sleeve hinge 40 in its locked position. To lock releasably lockable sleeve hinge 40, rigid sleeve 44 may be forced toward deformable sleeve 48 so that the inner surface of rigid sleeve 44 frictionally engages the outer surface of deformable sleeve 48. This friction fit locks sleeve 44 into place on deformable sleeve 48, connecting two tubular components together in a straight line. To unlock releasably lockable sleeve hinge 40, rigid sleeve 44 need only be forced away from deformable sleeve 48 to expose bendable connection mechanism 46. When releasably lockable sleeve hinge 40 is unlocked, the two tubular components connected together with releasably lockable sleeve hinge 40 may pivot relative to one another.

Figure 12:
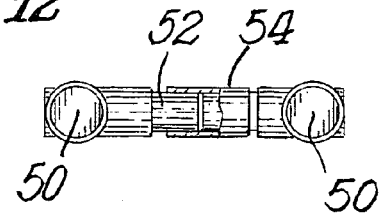
FIG. 12 is a bottom plan view partially broken away to show the lockable leg portions of the goal assembly shown in FIG. 11, the lockable leg portions being shown in their locked position.

FIGS. 11 and 12 show lockable leg portions 42 in their locked positions. Each lockable leg portion 42 includes a foot section 50 and either a male or female connector section. A male connector section is designated in these Figures as reference numeral 52, and a female connector section is designated as reference numeral 54. To lock leg portions 42 together, male connector section 52 may be forced toward female connector section 54 so that the outer surface of the male connector section 52 frictionally engages the inner surface of female connector section 54. This friction fit locks male connector section 52 into place on female connector section 54. Lockable leg portions 42 may be constructed of the same materials as tubular components of goal assembly 10.

It can therefore be seen that the present invention provides an inexpensive, lightweight, sturdy, self-contained, portable goal assembly 10 that can be used, indoors and outdoors, for informal games of soccer, as well as other sports requiring a goal. Goal assembly 10 may be collapsed without disassembling or removing any component part, and thus may be set up quickly (e.g., in less than half a minute) and easily without having to wrestle with the fitting of pieces or attachment of a net, or incurring possible loss of parts when goal assembly 10 is in storage mode or being transported. Furthermore, the locking mechanisms are easily and safely manipulated, even by small children, for opening and closing goal assembly 10 for use. The folded configuration and strap provides a convenient mechanism for carrying goal assembly 10 to desired locations.

It will be apparent to those skilled in the art that various modifications and variations can be made in the goal assembly of the present invention and in construction of the goal assembly without departing from the scope or spirit of the invention. As an example, various materials of construction may be used for present invention, as long as the materials are lightweight. As another example, various dimensions may be employed for the goal assembly and its components, depending upon the use of the goal assembly (e.g., goal assembly may be larger if used for soccer than if used for hockey).

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A portable goal assembly that folds in two dimensions, comprising:

a goalmouth frame comprising a crossbar and two side posts rigidly connected to the crossbar, said goalmouth frame being adapted to rest generally upright upon the ground, the crossbar and two side posts defining an upright rectangular front opening; and a base frame comprising a rearward cross member and two side members rigidly connected to the rearward cross member and pivotally connected to the side posts of said goalmouth frame, said base frame being adapted to rest on the ground, the rearward cross member being pivotal in a direction perpendicular to its length, wherein said goalmouth frame is adapted to pivot towards said base frame to fold the goal assembly flat, the crossbar and the rearward cross member are adapted to pivot along their lengths to fold the goal assembly in half, the crossbar pivots in a direction perpendicular to its length with a releasably lockable sleeve hinge, and the releasably lockable sleeve hinge comprises a bendable connection mechanism connecting two sections of the crossbar, and a hollow rigid sleeve through which the crossbar extends, the rigid sleeve being capable of frictionally engaging one section of the crossbar to lock the releasably lockable sleeve hinge, and having at least one diagonal brace comprising two elongate members pivotally connected to each other, wherein a first elongate member pivotally connects to the crossbar, and a second elongate member pivotally connects to the rearward cross member.

2. A portable goal assembly as recited in claim 1, wherein said diagonal brace provides support and rigidity to the goal assembly.

3. A portable goal assembly as recited in claim 1, wherein the two elongate members pivotally connect to each other with a second releasably lockable sleeve hinge.

4. A portable goal assembly as recited in claim 3, wherein the second releasably lockable sleeve hinge comprises a second bendable connection mechanism connecting the two elongate members, and a second hollow rigid sleeve through which the two elongate members extend, the second rigid sleeve being capable of frictionally engaging one elongate member to lock the second releasably lockable sleeve hinge.

5. A portable goal assembly as recited in claim 3, wherein the second releasably lockable sleeve hinge comprises a second bendable connection mechanism connecting the two elongate members, a second hollow rigid sleeve through which the two elongate members extend, and a stop mechanism connected to one elongate member and capable of stopping the second rigid sleeve to lock the second releasably lockable sleeve hinge.

6. A portable goal assembly as recited in claim 1, wherein each side post pivotally connects with its corresponding side member with a hinge.

7. A portable goal assembly as recited in claim 6, wherein the hinge comprises an elbow fitting having a threaded tubular extension, a tee fitting through which the threaded tubular extension extends, and a cap threadably received on the threaded tubular extension for forcing the tee fitting towards the elbow fitting.

8. A portable goal assembly as recited in claim 1, wherein the rearward cross member pivots in a direction perpendicular to its length with a hinge.

9. A portable goal assembly as recited in claim 8, wherein the hinge comprises an elbow fitting having a threaded tubular extension, a tee fitting through which the threaded tubular extension extends, and a cap threadably received on the threaded tubular extension for forcing the tee fitting towards the elbow fitting.

10. A portable goal assembly as recited in claim 1, wherein the elongate members of the diagonal brace pivotally connect to the crossbar and the rearward cross member with hinges.

11. A portable goal assembly as recited in claim 10, wherein each hinge comprises an elbow fitting having a threaded tubular extension, a tee fitting through which the threaded tubular extension extends, and a cap threadably received on the threaded tubular extension for forcing the tee fitting towards the elbow fitting.

12. A portable goal assembly as recited in claim 1, wherein the base frame comprises a lockable leg portion that locks the goal assembly together when the goal assembly is folded in two dimensions.

13. A portable goal assembly as recited in claim 12, wherein each the lockable leg portion comprises a foot section capable of supporting the goal assembly when the goal assembly is folded in two dimensions, and a connector section to lock the goal assembly together when the goal assembly is folded in two dimensions.

14. A portable goal assembly that folds in two dimensions, comprising:

a goalmouth frame comprising a crossbar and two side posts rigidly connected to the crossbar, said goalmouth frame being adapted to rest generally upright upon the ground, the crossbar and two side posts defining an upright rectangular front opening; and a base frame comprising a rearward cross member and two side members rigidly connected to the rearward cross member and pivotally connected to the side posts of said goalmouth frame, said base frame being adapted to rest on the ground, the rearward cross member being pivotal in a direction perpendicular to its length, wherein said goalmouth frame is adapted to pivot towards said base frame to fold the goal assembly flat, the crossbar and the rearward cross member are adapted to pivot along their lengths to fold the goal assembly in half, the crossbar pivots in a direction perpendicular to its length with a releasably lockable sleeve hinge, and the releasably lockable sleeve hinge comprises a bendable connection mechanism connecting two sections of the crossbar, a hollow rigid sleeve through which the crossbar extends, and a stop mechanism connected to one section of the crossbar and capable of stopping the rigid sleeve to lock the releasably lockable sleeve hinge, and having at least one diagonal brace comprising two elongate members pivotally connected to each other, wherein a first elongate member pivotally connects to the crossbar, and a second elongate member pivotally connects to the rearward cross member.

15. A portable goal assembly as recited in claim 14, wherein the two elongate members pivotally connect to each other with a second releasably lockable sleeve hinge.

16. A portable goal assembly as recited in claim 14, wherein the base frame comprises a lockable leg portion that locks the goal assembly together when the goal assembly is folded in two dimensions.

* * * * *